United States Patent [19]

Wüsthof et al.

[11] Patent Number: 4,747,339

[45] Date of Patent: May 31, 1988

[54] RADIAL PISTON MACHINE

[75] Inventors: Peter Wüsthof, Lohr, Fed. Rep. of Germany; Sinclair Cunningham, Kinghorn, Scotland

[73] Assignee: Mannesmann Rexroth GmbH, Lohr, Fed. Rep. of Germany

[21] Appl. No.: 893,892

[22] Filed: Jul. 29, 1986

[30] Foreign Application Priority Data

Sep. 5, 1985 [DE] Fed. Rep. of Germany ..... 3531632

[51] Int. Cl.[4] ..... F04B 1/10

[52] U.S. Cl. ..... 92/148; 92/58; 92/72

[58] Field of Search ..... 92/12.1, 58, 72, 148; 91/491

[56] References Cited

U.S. PATENT DOCUMENTS

| | | | |
|---|---|---|---|
| 1,321,146 | 11/1919 | Ragot | 92/58 |
| 2,945,451 | 7/1960 | Griswold | 92/148 X |

FOREIGN PATENT DOCUMENTS

| | | | |
|---|---|---|---|
| 191674 | 8/1986 | European Pat. Off. | 91/491 |
| 2546140 | 5/1976 | Fed. Rep. of Germany | 92/58 |
| 1330868 | 4/1902 | France | 92/58 |
| 2128265 | 4/1984 | United Kingdom | 91/491 |

*Primary Examiner*—A. Michael Chambers
*Assistant Examiner*—John C. Fox

[57] ABSTRACT

In a radial piston machine which includes a driven rotatable rotor with radial pistons displaceable in radial recesses of the rotor by pressure medium and carrying rollers which cooperate with a cam track of the rigid cam plate, the length of the rollers can be increased due to the provision in the bores receiving the rollers respective opposing recesses in which portions of the roller are received.

3 Claims, 3 Drawing Sheets

FIG. 3
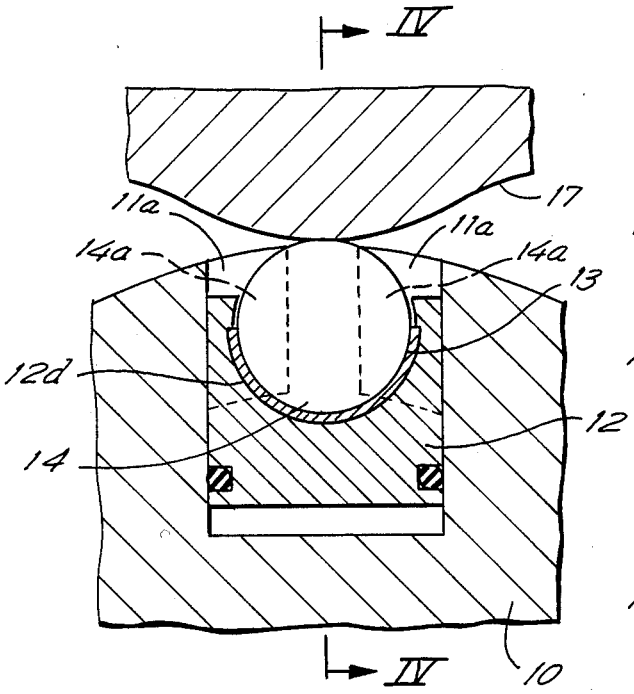
FIG. 4
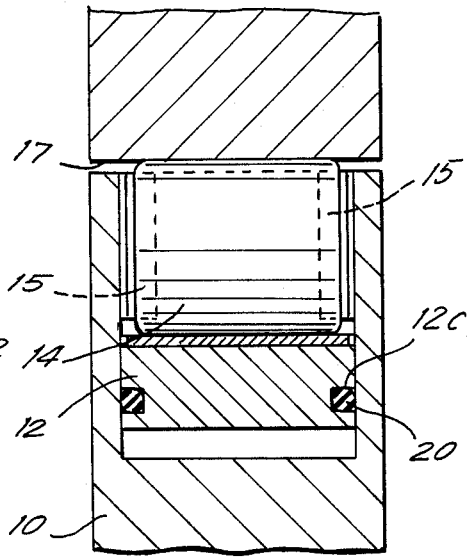
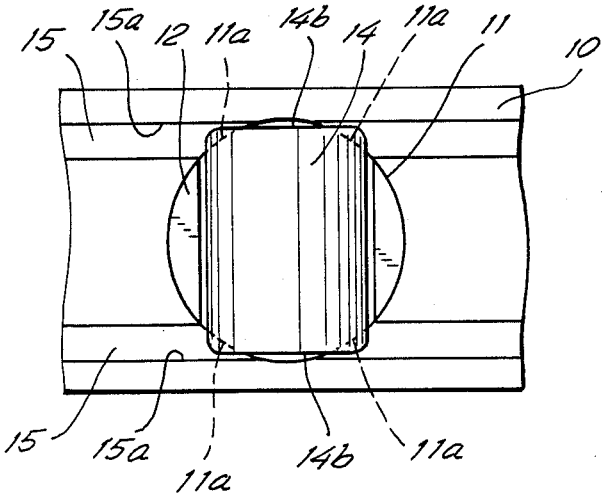
FIG. 5

RADIAL PISTON MACHINE

BACKGROUND OF THE INVENTION

The present invention relates to a radial piston machine.

Radial piston machines of the type under consideration normally include a housing formed of two halves, a cam plate connected with the housing halves into an integral unit and a rotor formed as a cylindrical block rotatable about its axis relative to the cam plate. A plurality of radial pistons are axially displaceable in bores formed at the periphery of the rotor, which pistons are driven by pressure medium. Rollers cooperating with the cam track of the cam plate are supported in the pistons. Such machines are characterized by compact and rather inexpensive structural components and high pressure capacity.

German Offenlegungsschift No. 3,216,007 and G. B. Patent No. 1,413,108 disclose a radial piston machine in which each roller on which the piston is supported at its projecting surface is positioned in the piston bore. The maximal length of such roller can amount, with a theoretically maximal roller diameter, only to 0.707 of the roller diameter.

SUMMARY OF THE INVENTION

It is an object of the present invention to provide an improved radial piston machine.

It is a further object of the invention to provide a radial piston machine which in addition of being compact would be provided with rollers of greater length as compared to those of conventional machines in order to reduce contact stresses (Hertz stresses) between the rollers and the cam plate and to thereby enhance the service life of the machine.

These and other objects of the invention are attained by a radial piston machine, comprising a cam plate having a cam track; a cylinder block rotatable about an axis thereof relative to said cam plate, said cylinder block being provided with a plurality of radially extended bores formed at a periphery thereof; a plurality of pistons displaceably supported in said bores; and cylindrical rollers each having an axis parallel to the axis of rotation of said cylinder block and supported against the cam track of said cam plate, said bores each having, in the region cam track, recesses, said rollers each having at both end faces thereof portions which are accommodated in said recesses.

Said recesses may be adjusted to the length of the roller which is in the range of 0.9 to 0.95 of a piston diameter.

The recesses may be defined by circular grooves provided at the outer periphery of said cylinder block and at least vertically cut in a radially external region of a respective one said bores.

The recesses may be axially limited so that a respective roller is at least partically guided at said end faces. Therefore side guide rings, usually utilized for such a purpose for the rollers, can be omitted.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 3 is a sectronal view of the radial piston with the roller and the part of rotor taken in the direction of the roller axis;

FIG. 4 is a sectional view taken along line IV—IV of FIG. 3; and

FIG. 5 is a top plan view of the piston with the roller.

DETAILED DESCRIPTION OF THE PREFERRED EMBODIMENTS

Figure 1:
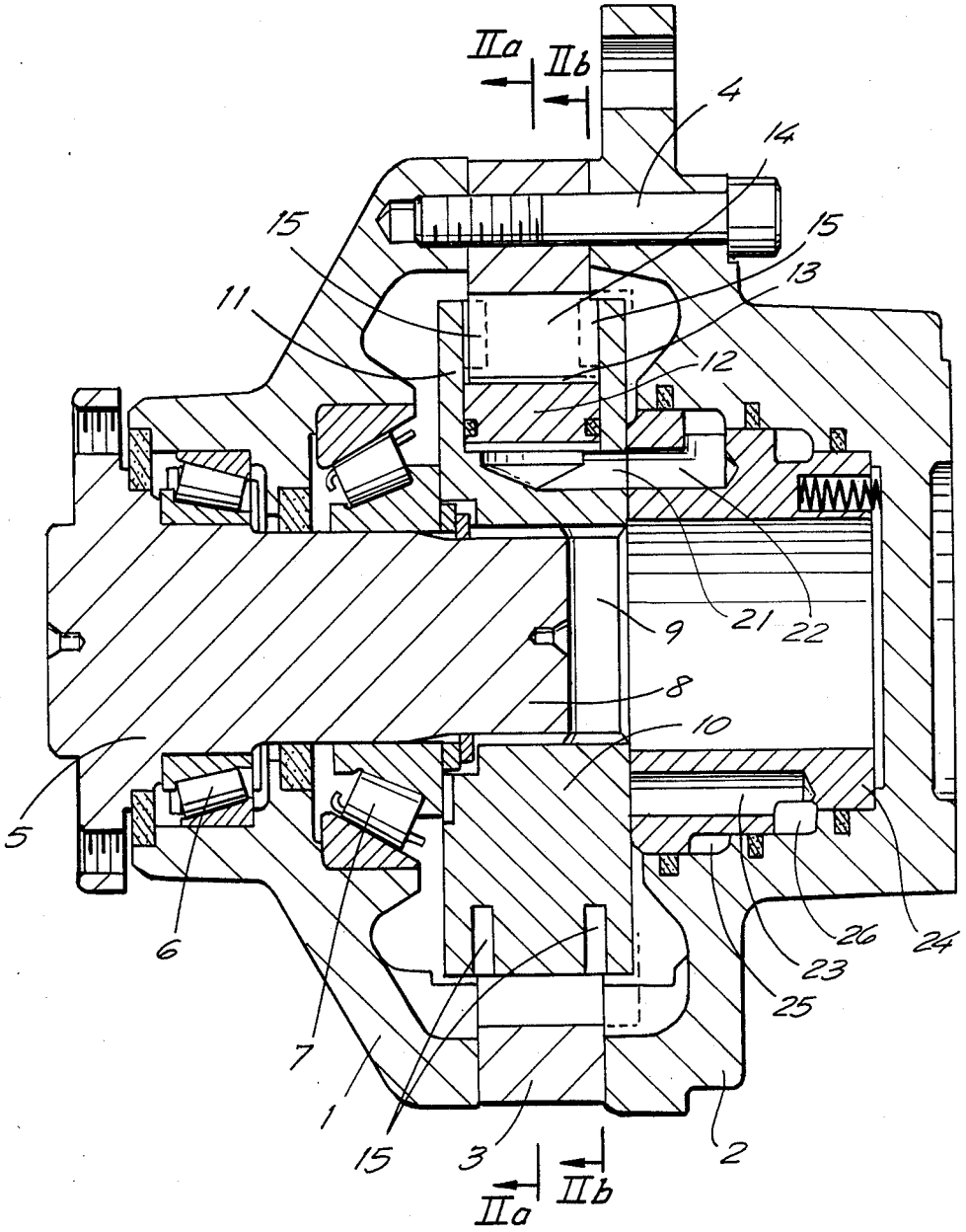
FIG. 1 is an axial sectional view of the radial piston machine according to the invention.
Figure 2A:
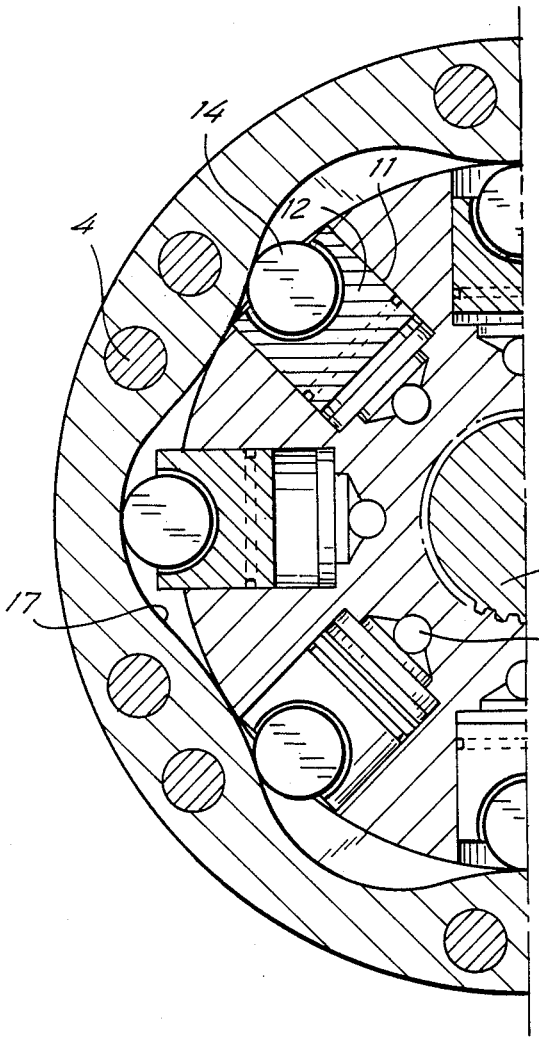
FIG. 2 shows at the left-hand part a section taken along line II*a*–II*a*, and at the right-hand part a section through line II*b*–II*b* of FIG. 1.
Figure 2B:
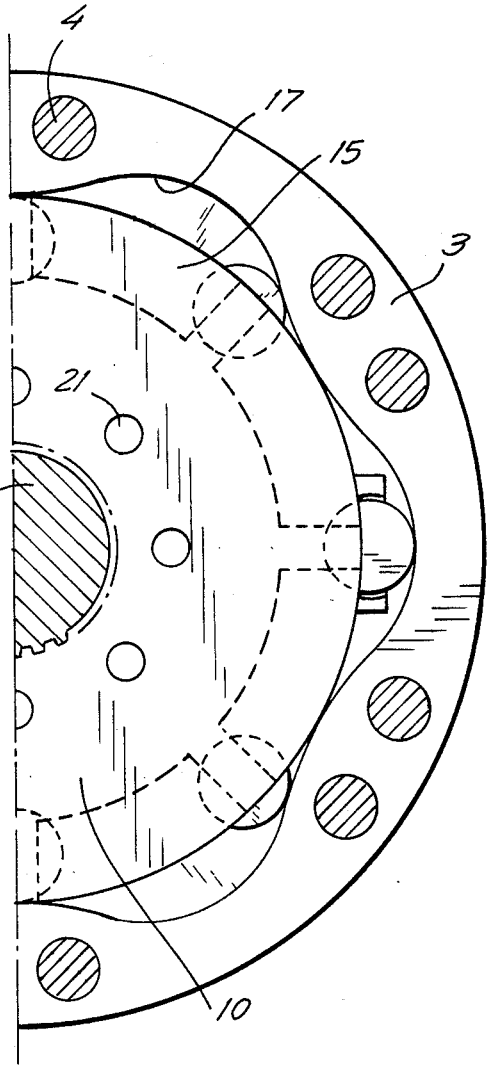

Referring now to the drawings in detail, and firstly to FIG. 1 thereof, it will be seen that a radial piston machine has a housing comprised of two housing halves 1 and 2. A cam plate 3 is arranged between these two housing halves. These two housing halves and the cam plate 3 are connected by fastening bolts 4 into a single integral unit. A shaft 5 is supported in the housing half 1 by means of roller bearings 6, 7. The housing-side end 8 of the shaft is formed as a splined shaft and supports via a corresponding recess 9 a rotor or cylindrical block 10. Rotor 10 has at the periphery thereof a plurality of circumferentially uniformly spaced radial bores or recesses 11 (FIG. 2) which receive radial pistons 12. Each piston has in its radially external region a recess **12*d* in which a bearing shell 13 receiving a cylindrical roller 14 is accommodated as clearly shown in FIG. 3. Rollers 14 are supported or abut against a cam track 17 provided on the cam plate 3. In the radially internal region, each piston has a circular groove 12 in which a sealing ring 20 is positioned. The piston chambers formed by bores 11 are in operational connection, via axially extending bores 21, with axial control bores 22, 23 (FIG. 1) of a control sleeve 24 fixed in the housing half 2. The control sleeve 24 limits annular control chambers 25, 26 which are in connection with conduits for a pressure medium source or for a tank. According to the position of the piston chambers formed by bores 11 relative to the control bores 22, 23, these piston chambers become connected either with the pressure medium source or the tank, and a torque is applied to the rotor 10 which displaces the same outwardly via the splined connection on the driving or driven shaft 5**.

As seen from FIG. 3 each bore 11 which receives a respective piston has four recesses **11*a* extending outwardly from the bore and receiving roller portions 14*a*. Recesses 11*a* derive from circular grooves 15 formed in the rotor 10 and are therefore parts of grooves 15. The grooves are dimensioned so that their outer limiting walls 15*a* form, at the same time, an axial guide of side faces 14*b* of the roller. The rollers can be in principle as long as desired. The longer are the rollers the greater must be the two-side rolling path-width of the grooves. Good structural compromise can be achieved if the roller length "l" is about 0.9 to 0.95 of the piston diameter. In this case the life span of the machine, as compared to conventional radial piston machines of this type, would be about 50 to 60% longer. The depth of the rolling path of the circular grooves 15** can be reduced because the rollers can be inserted partially into the protruding piston bores.

It will be understood that each of the elements described above, or two or more together, may also find a useful application in other types of radial piston machines differing from the types described above.

While the invention has been illustrated and described as embodied in a radial piston machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims,

1. A radial piston machine, comprising a cam plate (3) having a cam track (17); a cylinder block (10) rotatable about an axis thereof relative to said cam plate, said cylinder block being provided with a plurality of radially extended bores (11) formed at a periphery thereof; a plurality of pistons (12) displaceably supported in said bores; and a plurality of cylindrical rollers (14) each having an axis parallel to the axis of rotation of said cylinder block and supported against the cam track of said cam plate, each of said bores having recesses (11*a*) in a region of said cam track, said rollers each having two end faces (14*b*) and being formed with portions (14*a*) provided at each end face, said portion accommodated in said recesses whereby said rollers are self-guided in said cylinder block, and wherein said recesses (11*a*) are defined by circular grooves (15) provided in said cylinder block and open at the periphery thereof and at least partially cut in a radially external region of a respective one of said bores.

2. The machine as defined in claim 1, wherein said recesses are adjusted to the length of the roller which is in the range of 0.9 to 0.95 of a piston diameter.

3. The machine as defined in claim 1, wherein said recesses are axially limited so that a respective roller is at least partially guided at said end faces (14*b*).

* * * * *